United States Patent [19]

Brown

[11] Patent Number: 4,503,576

[45] Date of Patent: Mar. 12, 1985

[54] ORTHOTIC APPLIANCE AND METHOD OF MAKING

[76] Inventor: Dennis N. Brown, 1091 Fir Ave., Blaine, Wash. 98230

[21] Appl. No.: 294,306

[22] Filed: Aug. 19, 1981

[51] Int. Cl.[3] ..... A43D 00/00

[52] U.S. Cl. ..... 12/146 M; 36/43

[58] Field of Search ..... 12/142 R, 142 N, 146 M; 36/43, 44; 264/222, 223, 227, DIG. 30, 101, 96

[56] References Cited

U.S. PATENT DOCUMENTS

| | | | |
|---|---|---|---|
| 3,895,405 | 7/1975 | Edwards | 12/146 M |
| 3,995,002 | 11/1976 | Brown | 12/142 R |
| 4,231,169 | 11/1980 | Toyama et al. | 36/43 |
| 4,237,626 | 12/1980 | Brown | 36/43 |

*Primary Examiner*—Kyle L. Howell
*Assistant Examiner*—Karin M. Reichle
*Attorney, Agent, or Firm*—Leonard Bloom

[57] ABSTRACT

An orthotic appliance and a method of making same in which the appliance is for use between a foot and a shoe, boot or the like and includes an insert which is to be placed between the foot and the boot, the insert is to be custom formed to correspond to the contour of an individual's foot. The insert is initially heated until its volume expands, thereafter the insert is placed on a platform and the two are adjoined to the foot. A vacuum bag is slid thereover, a vacuum is formed within the bag, and thereafter the insert takes the configuration of the bottom face of the foot. Additionally, foot pressure may be applied to augment the degree of conformation of the insert to the foot, and in other embodiments an additional heel insert is placed below the major insert, and a crest piece is placed between the ball and toe area of the insert on the underside thereof so that this additional material can be bonded to the major insert and also conform to the user's foot.

18 Claims, 19 Drawing Figures

ORTHOTIC APPLIANCE AND METHOD OF MAKING

BACKGROUND OF THE INVENTION

The appreciation of the need for an orthotic insert to be placed between a shoe and the person's foot has increased substantially within the last few years now that one's awareness of physical fitness has become greater.

Moreover, the penalties associated with improper footwear in terms of support and design have become painfully evident to a large majority of exercisers since deficient designs become readily apparent when an associated physical problem becomes manifest due to the increased exercise now being undertaken in general.

The ensuing patent application deals with improvements over applicant's own patents, U.S. Pat. No. 3,995,002 issued Nov. 30, 1976, and U.S. Pat. No. 4,237,626 issued Dec. 9, 1980.

The former may be regarded as teaching the use of an orthotic casting system in which a negative mold is developed which is used to produce a positive form having the general contour of a person's foot which is then used as a base upon which an orthotic device is constructed traditionally at a remote site.

The latter is concerned with providing angulation for the heel portion of a person's foot by providing a heel insert which is deformable and when suitably manipulated can be deformed so that the contour of one's foot can be reflected in the insert, while at the same time beneficial angulation of the foot can simultaneously occur.

SUMMARY AND OBJECTS OF THE INVENTION

The ensuing application is directed to and provides advantages in the state of the art neither contemplated nor rendered obvious by the foregoing patent subject matters when considering the following detailed specification when taken in conjunction with the drawing figures. Generally however the instant application is directed to an orthotic appliance in which the entire foot geometry can be taken into account similar to the older system, but the system according to the present application does not require that the negative mold be used to produce a positive form, rather that the negative mold serve as the insert itself. This system therefore bypasses the negative cast and thereby provides custom orthosis while eliminating the most time consuming prior art step. This of course has the added benefit of allowing a person suffering from improperly fitting footwear or symptomatic fee to experience instantaneous support by having the orthotic device readily available, rather than having to wait for the positive form to be made after which the support insert is thereafter constructed. Moreover, the apparatus according to the instant application provides a device which addresses not only the problems relating to angulation of the foot, but also provides benefits for the toe and ball area and arch support areas of the foot.

Fairly recently, greater attempts have been made to provide footwear which is anatomically correct so as to not only increase the comfort of the wearer, but also to minimize fatigue and injuries. This requires an analysis of the typical human gait. When one is moving substantially in a single linear direction, the gait consists of three distinct phases. First, the heel strike phase occurs during which the foot is essentially a "mobile adapter" ready to conform to the typographical contours encountered. Some of the impact forces are dissipated through the ankle and leg bones to the upper torso, while other impact forces are translated into the foot. The proper dissipation and translation of these forces during the heel strike phase produce a natural shock absorption mechanism. Second, the translation or mid gait phase transforms the mobile adapter into a rigid lever whereby the mid-tarsal joint becomes locked preparing the foot for translation of the accumulated and developing forces in a stable manner throughout the foot during the remainder of said cycle and the ensuing final phase called toe roll. This is the final propulsive and translatory phase of gait. After the toe leaves the ground the swing phase of the next step begins. The critical phase is the mid-gait or transition phase where the foot is transformed from a "mobile adapter" to a "rigid lever". The optimum configuration for the ankle and tarsal joint at this point is to have the sub-talar joint in a neutral position as the mid-tarsal joint becomes locked and the foot becomes a "rigid lever". This allows the impact load to be properly dissipated and translated. While podiatrists have long been aware of the need to maintain the foot's proper orientation relative to the leg to provide a "rigid lever" and accordingly have prescribed orthoses for the purpose, the general populace rarely avails themselves of these services until after a certain amount of discomfort and/or damage has been done.

Accordingly, this application has an objective to provide an orthotic appliance whose original blank contour can be changed at a later date to provide conformation with an individual's foot.

It is a further object of this invention to provide a device of the character described above in which the orthosis can be fabricated immediately and simultaneously by the conformation of the insert to the foot.

It is yet a further object of this invention to provide a device of the character described above which is relatively inexpensive to manufacture, reliable in service, and extremely accurate in its ability to follow compound contours of a person's foot.

It is yet a further object of this invention to provide a device of the character described above in which accommodation and compensation for a plurality of orthotic needs can be reflected in one insert at one fitting or alternatively at the time of fabrication, and even at a later date.

These and other objects will be made manifest when considering the following detailed specification when taken in conjunction with the appended drawing figures.

BRIEF DESCRIPTION OF THE DRAWING FIGURES

Figure 18:
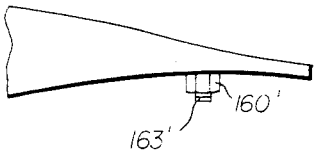
Figure 18A:
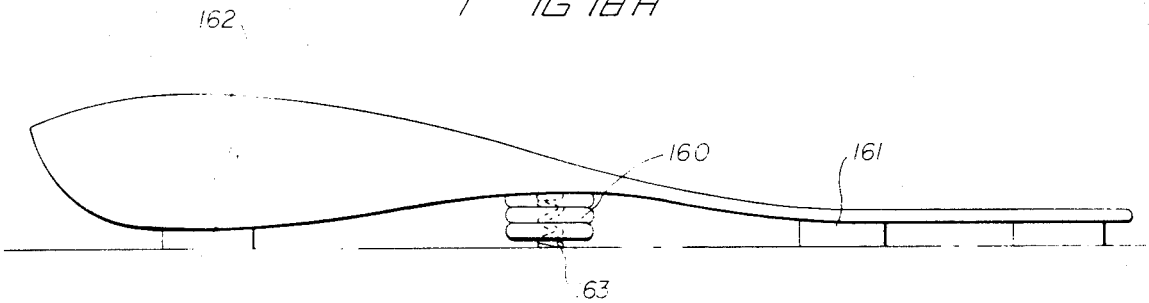

FIGS. 18 and 18A teach the use of an alternative arch supports.

BRIEF DESCRIPTION OF THE PREFERRED EMBODIMENTS

Referring to the drawings now, wherein like references numerals refer to like parts throughout the various drawing figures, reference numeral 10 is directed to the orthotic appliance according to the present invention.

Figures 1, 2, 3, 4, 5, 6, 7, 8, 9, 10:
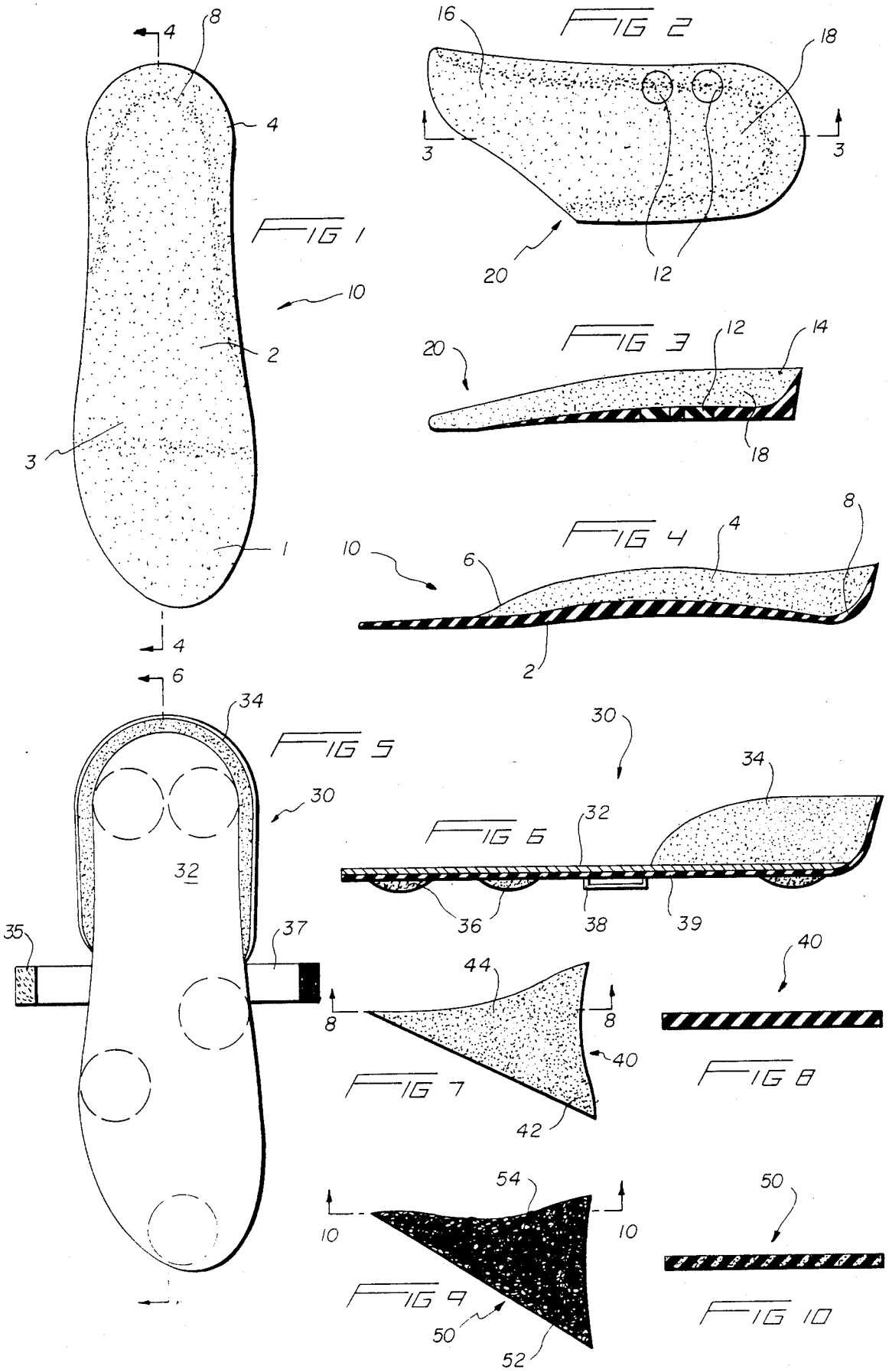
FIG. 1 is a top plan view of the insert according to the present invention.
FIG. 2 is a top plan view of a heel insert which is intended to be used with the insert of FIG. 1.
FIG. 3 is sectional view taken along lines 3—3 of FIG. 2.
FIG. 4 is a sectional view taken along lines 4—4 of FIG. 1.
FIG. 5 is a top plan view of a foot support which underlies the inserts of FIGS. 1 and 2 to be used in the conformation process.
FIG. 6 is a sectional view taken along lines 6—6 of FIG. 5.
FIG. 7 is a top plan view of a toe cresting appliance to be used with the insert of FIG. 1.
FIG. 8 is a sectional view taken along line 8—8 of FIG. 7.
FIG. 9 is a rubber cushion which is adapted to be used with the toe cresting piece of FIG. 7.
FIG. 10 is a sectional view taken along lines 10—10 of FIG. 9.

The appliance 10 is shown in FIGS. 1 and 4 to be made of an elastic, rubberized, resilient type of material which in a preferred form is cork and resin. The device has the shape of a blank generally conforming to one's foot and there is an area between the toe and the ball 1 and 3 respectively, and an upwardly extending rim 4 which extends about the foot's heel area, the depression 8 noting the approximate location of the heel of the user. The raised central area 2 conforms to the person's arch area and is of somewhat greater thickness. The rim 4 terminates just forward of the arch 2 and near the ball area, this termination bearing the legend 6.

Figure 13:
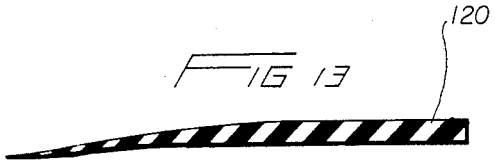
FIG. 13 is an alternative embodiment of FIG. 3.
Figure 16:
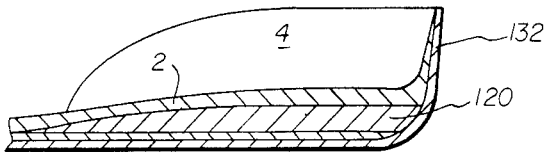
FIG. 16 is similar view, of the righthand side thereof showing the alternative heel insert of FIG. 13.

A heel insert 20 is further provided which underlies the main insert 10, and the heel insert is made of similar material. The heel insert 20 includes a plurality of plug elements 12 whose purpose has been explained in U.S. Pat. No. 4,237,626, but briefly the plugs 12 are removed prior to the heating step to be described hereandafter so that the plugs 12 do not expand and are not capable of deformation at a later stage. Similarly, the heel insert 20 is provided with a depressed heel area 18 and optionally an upwardly extending perimeter lip portion 14 that extends around the heel and is capable of being nested within the rim of insert 10. The heel insert has an arch area 16 on one edge thereof, the other edge terminates substantially where the heel ends. FIG. 13 shows a substantially flat heel insert 120. This flat insert as shown in FIGS. 13 and 16 provide a custom contour heel support in which a buildup above and around the plantar surface of the heel is not necessary, either due to clearance or other reasons.

A further component in this orthotic appliance includes a crest piece 40 which as shown in FIG. 7 is of generally triangular shape, the one tip 42 especially formed to be oriented just below the area between one's big toe and the adjoining toe. The rearward portion of the triangular crest piece 44 extends substantially along the line where the ball of one's foot ends and the toes begin. Similarly, the rubber crest piece 50 which is intended to be deployed between the crest piece 40 and the bottom face of the insert 10 has a similar configuration wherein line 54 is intended to correspond with the terminal portion of the ball of the foot, and pointed area 52 is to be disposed between the big toe and its adjoining toe. Except for the cushioned piece 50, all of the herein described inserts and crest pieces are preferred to be formed from a cork resin which when heated increases its original volume substantially and is thereafter permanently deformable when so heated, but thereafter when cooled maintains a set position defined by the deformation when hot.

FIGS. 5 and 6 teach the use of a platform for support, this support platform 30 being used to act as a bearing surface against which deformation can be controlled so that the composite insert will still be capable of insertion within a shoe, boot, or the like. The support 30 includes a plate 32, an upwardly extending peripheral heel support 34 which controls the amount of distortion of the insert heel support rim 4 and lip 14. An optional underlying resilient cushion 39 is bonded to the plate, and has plural depending weight bearing termini extending from the cushion. The termini 36 are shown as portions of spheres with a planar side. The orientation of these termini 36 are important in that when vacuum and foot pressures are applied upon the insert as it is being deformed, these termini tend to localize and direct the areas of deformation to areas of traditional greatest need. As shown in FIG. 5 for example two such termini are provided around the heel area, one provided forwardly of the arch where the ball area is, and another disposed forwardly near the major load bearing area of the big toe and a fifth remaining termini just below the little toe closest to the side edge of the foot.

In addition, means for affixing the support platform 30 to the foot are provided and as shown in the drawings comprise a closed loop 38 on either side of the platform along edges thereof through which a strap 37 is deployed at whose extremities a fastener means is provided, preferably Velcro type fasteners 35.

Figure 14:
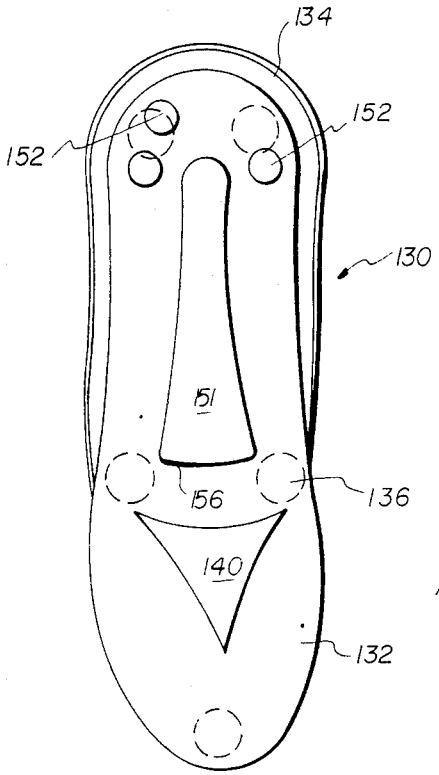
FIG. 14 is an alternative embodiment of FIG. 5.
Figure 17:
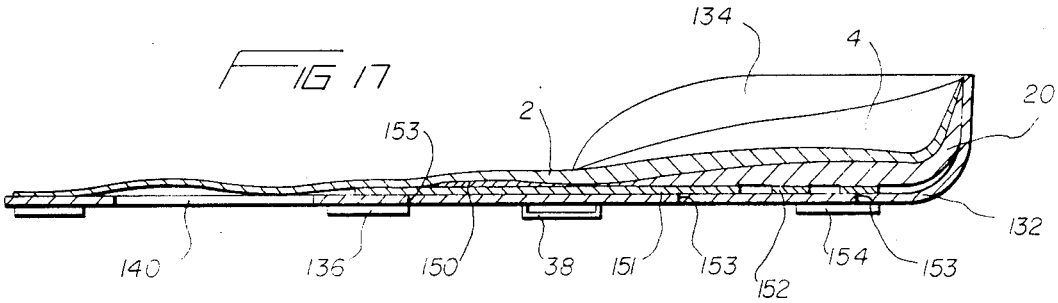
FIG. 17 is view similar to FIG. 15 showing a second form of the platform of the platform shown in FIG. 14.

FIGS. 14 and 17 each teach the use of a further preferred embodiment when contrasted with FIG. 5 for example of the support platform 130. The support 130 includes a plate base member 132, an upwardly extending peripheral heel support 134 which controls the amount of distortion of the heel insert portions rim 4 and lip 14 of FIGS. 3 and 4. Also similarly, a plurality of depending weight bearing termini 136 are provided on the bottom face for purposes similar to those set forth in the previous embodiment. Note however the cutout area 140 which defines an opening on the plate 132 corresponding geometrically substantially to the toe cresting piece. With the opening 140, and with a vacuum applied as shown in FIGS. 11 and 12, the toe cresting can proceed by deformation of the major insert 10 without the need for building up under the toe area with the cresting pieces 40 and 50.

Additionally, it is possible to provide an alternative configuration to the plugs 12 that were set forth hereinbefore. Specifically, a plurality of discs 152 having downwardly depending pins 153 adapted to fit within recesses 154 of the support platform can be deployed so that when molding, the insert 10 or the heel insert 120 (or 20) can have suitable indentations for the slidable and frictional reception therein of resilient plugs for purposes similar to that which was set forth for plugs 12.

In addition however FIGS. 14 and 17 reveal a recess forming means 151, an elongate blade, runs the longitudinal extent of the support 132 from the heel area to the metatarsal. As shown, the recess forming means 151 has an arcuate heel portion preferably formed with a feathered edge, and a forwardly outwardly flared leading portion 156. Similar to the plugs 152, the recess forming means 151 is supported by means of downwardly extends pins 153 adapted to be received with recesses 154 of the support platform. With the recess as shown, a void is provided under the foot and on the bottom face of the insert. The dimensions of the void are precisely calculated to assure that loads transmitted from the plantar portion of a person's foot is efficiently transmitted up the leg through the ankle, by encouraging proper orientation of the midtarsal joint. That is to say, loads imposed upon the foot are transmitted in an anatomically correct manner through the ankle and up the leg.

Figure 11:
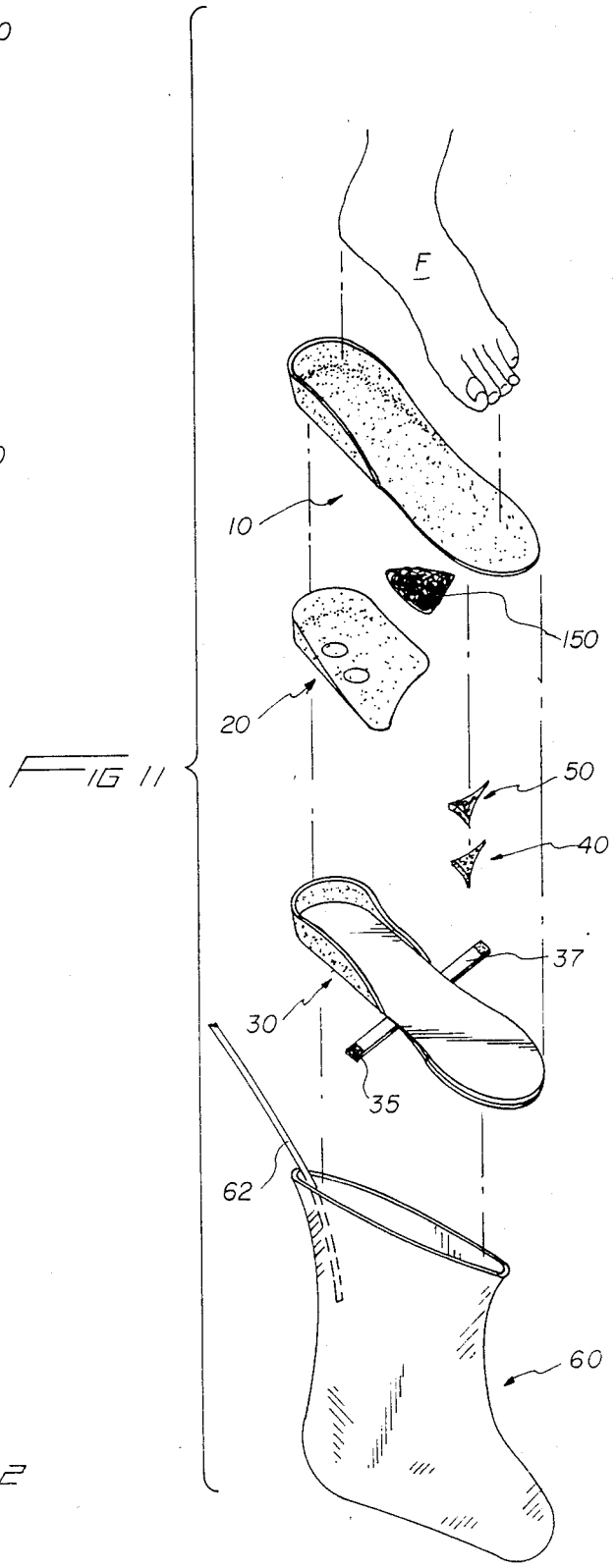
FIG. 11 is an expanded perspective view of all of the components delineated hereandabove as they are to be assembled for conformation with one's foot and includes a vacuum process.
Figure 12:
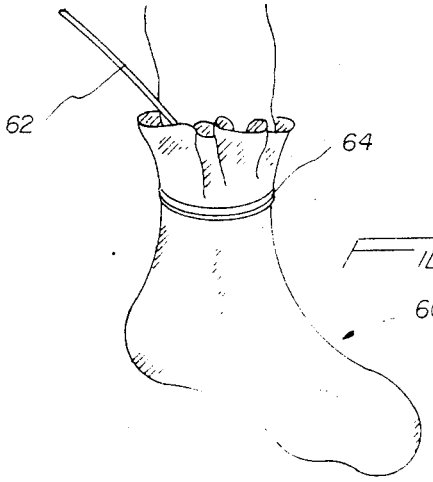
FIG. 12 is a perspective view of that which is shown in FIG. 11 when all components have been assembled, and the air tight bag is ensconced around the foot.
Figure 15:
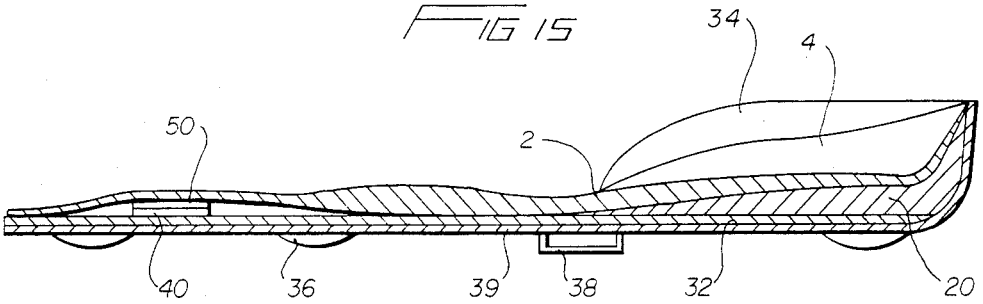
FIG. 15 is sectional view of the device shown in FIG. 11 exclusive of the bag.

FIGS. 11 and 12 delineate a preferred method of utilizing the above defined appliance in which the entire assemblies discussed above are affixed to a person's foot as shown in FIG. 11 and thereafter an air tight bag 60 is slidably disposed thereover in which the bag includes a source of applying vacuum as through tube 62. Once the appliance has been thusly inserted within the bag the top area of the bag is sealed as with elastic bands 64 and the tube 62 extends therebelow to evacuate air within the bag chamber proper. This has the net effect of encouraging deformation of the heated insert, half insert, and crest piece in conforming engagement with the person's foot F after which an increased amount of deformation can occur by applying foot pressure downwardly upon the appliance. It is contemplated that the foot will be in a relatively neutral position as defined in previous patent documents referenced hereandabove, so that the appliance thus formed will comprise the insert 10, conceivably the heel insert 20, and, if desired, the toe cresting piece 40 which would have a resilient cushion 50 interposed between the cresting piece 40 and the bottom face of the insert. In this manner, conformation between the insert and the person's foot can be assured.

FIG. 11 also is directed to the filler material 150 to provide arch support should the person being fitted have high arches. It is to be noted that the materials in this custom orthosis will expand substantially to three to four times its original volume, and should this expansion not be adequate, a resilient arch support 150 can be provided similar to the toe cresting piece 50 having similar purposes. As shown, the arch support 150 is placed between the heel insert and the full insert and is of substantially flattened conical shape.

FIG. 18A teaches the use of an alternative arch support defined by a spring support 160 (160" FIG. 18) having an internal spring 163 (163 FIG. 18) disposed therein. Also shown in FIG. 18A, the insert 162 is elevated from the insert supporting surface by means of the supporting feet 161.

Having thus described the invention, it should be apparent that numerous structural modifications are contemplated as being part of this invention as set forth hereinabove and as defined hereinbelow by the claims.

What is claimed is:

1. A method of forming an orthotic appliance comprising the steps of:

forming an insert of expandible material, heating and expanding the insert until it is dimensioned larger than when cool, providing a support platform with an open top area for access to a top of a foot, placing the insert on the support platform, affixing the platform to a foot to be fitted, covering the foot in an air tight bag, inserting a vacuum conduit into the bag, securing the bag in an air tight relation about the foot, orienting the mid-tarsal of the foot for correct alignment in a neutral non-flexed position, applying the vacuum whereby the insert is drawn tightly against the foot, being conformed thereto, and cooling the insert to allow it to set up whereby the insert defines the appliance.

2. The method of claim 1 including applying foot pressure to the insert before cooling while the foot and midtarsal are correctly aligned.

3. The method of claim 1 including heating a heel insert, and introducing the heel insert between the insert and support platform prior to affixing the support platform to the foot.

4. The method of claim 1 including heating a crest piece, and introducing the crest piece between the insert and support platform prior to affixing the support platform to the foot.

5. The method of claim 4 including applying a cushion crest piece between the crest piece and the insert prior to affixing the support platform to the foot.

6. The method of claim 1 including placing a longitudinally elongate blade between the insert and the support platform prior to affixing the support platform to the foot whereby the blade forms a longitudinal recess in the insert.

7. A method of forming an orthotic appliance so as to identically conform to a plantar surface of a person's foot when molded thereagainst and molding the appliance so as to continuously orient the foot in an optimal relationship for the foot's midtarsal joint comprising the steps of:

providing an initial insert blank of cork-resin which is adapted to expand when heated, heating the blank until it expands, placing the blank against the planar portion of the foot, orienting the foot so that the midtarsal joint is in a neutral non flexed position, deforming the insert against the foot including providing a support platform with an open top area for access to a top of the foot against the surface of the insert remote from the foot, affixing the platform to the foot, placing a baglike shroud over the platform, insert and foot, inserting a vacuum conduit into the shroud, sealing the shroud in an air tight relation about the foot and applying the vacuum to cause the deformation, and allowing the insert to set up whereby the insert defines the appliance and when set and non-deformable is still resilient.

8. The method of claim 7 including placing a recess in the insert on a surface of the insert adjacent the support platform by: interposing an elongate blade between the insert and the support platform prior to deforming, orienting the blade adjacent the calcanial area of a person's foot and extending forwardly along the longitudinal axis of the foot towards the metatarsal head area.

9. The method of claim 7 including building up the arch area of the insert by placing resilient material between the insert and the platform prior to deformation.

10. The method of claim 7 including applying foot pressure to the insert while the insert is still deformable and not set with the foot and mid-tarsal in correct alignment, and applying the pressure when the platform is still disposed adjacent the insert.

11. The method of claim 7 including providing a heel insert adapted to be placed under the heel portion of the initial insert blank, forming the heel insert from cork resin, heating the heel insert until it expands and deforming the heel insert with the initial blank insert by placement of the heel insert between the initial blank insert and the support platform prior to deformation.

12. The method of claim 7 including forming a triangular shaped further insert of cork and resin, placing the triangular insert defining a cresting piece on the initial blank adjacent and underlying the initial blank between the platform and the blank adjacent the toe area, heating the toe cresting piece prior to placement so that it expands and deforming the toe cresting piece with the initial blank insert.

13. A method of forming an orthotic appliance so as to identically conform to a plantar surface of a person's foot when molded thereagainst and molding the appliance so as to continuously orient the foot in an optimal relationship for the foot's midtarsal joint comprising the steps of:

providing an initial insert blank of cork-resin which is adapted to expand when heated, heating the blank until it expands, placing the blank against the plantar portion of the foot, orienting the foot so that the midtarsal joint is in a neutral non flexed position, forming the support platform so as to have a bottom surface and a peripheral heel area but maintaining an open top area, and deforming the insert against the foot by placing the support platform against the surface of the initial blank insert remote from the foot, affixing the platform thereto, placing a bag-like shroud over the platform, insert and foot, inserting a vacuum conduit into the shroud, sealing the shroud in an air tight relation about the foot and applying the vacuum to cause deformation and allowing the insert to allow it to set up whereby the insert defines the appliance and when set and non-deformable is still resilient.

14. The method of claim 13 including placing a recess in the insert on a surface of the insert adjacent the support platform by: interposing an elongate blade between the insert and the support platform prior to deforming, orienting the blade adjacent the calcanel area of a person's foot and extending forwardly along the longitudinal axis of the foot towards the metatarsal head area.

15. The method of claim 13 including building up the arch area of the insert by placing resilient material between the insert and the platform prior to deformation.

16. The method of claim 13 including applying foot pressure to the insert while the insert is still deformable and not set with the foot and mid-tarsal in correct alignment, and applying the pressure when the platform is still disposed adjacent the insert.

17. The method of claim 13 including providing a heel insert adapted to be placed under the heel portion of the initial insert blank, forming the heel insert from cork resin, heating the heel insert until it expands and deforming the heel insert with the initial blank insert by placement of the heel insert between the initial blank insert and the support platform prior to deformation.

18. The method of claim 13 including forming a triangular shaped further insert of cork and resin, placing the traingular insert defining a cresting piece on the initial blank adjacent and underlying the initial blank between the platform and the blank adjacent the toe area, heating the toe cresting piece prior to placement so that it expands and deforming the toe cresting piece with the initial blank insert.

* * * * *